United States Patent [19]

Clinton et al.

[11] Patent Number: 4,594,166

[45] Date of Patent: Jun. 10, 1986

[54] DESLUDGING DEVICE FOR CENTRIFUGES

[75] Inventors: William D. Clinton, 313 Custis Rd., Glenside, Pa. 19038; Donald J. Hess, Willow Grove, Pa.

[73] Assignee: William D. Clinton, Glenside, Pa.

[21] Appl. No.: 715,926

[22] Filed: Mar. 25, 1985

[51] Int. Cl.[4] ..... B04B 11/00; B04B 15/06

[52] U.S. Cl. ..... 210/107; 210/141; 210/145; 210/147; 210/369; 210/374; 494/10; 494/35; 134/144

[58] Field of Search ..... 210/107, 369, 374, 376, 210/375, 143, 141, 145, 96.1, 97, 147; 494/10, 35, 27, 37, 57, 58, 59; 134/144, 56 R

[56] References Cited

U.S. PATENT DOCUMENTS

| | | | |
|---|---|---|---|
| 490,040 | 1/1893 | Peck | 494/59 |
| 614,764 | 11/1898 | Robbé | 210/369 |
| 2,078,273 | 4/1937 | Pecker | 210/375 |
| 2,106,964 | 2/1938 | Wells | 494/57 |
| 2,206,401 | 7/1940 | Hoffman | 210/369 |
| 2,443,310 | 6/1948 | Eckers | 494/57 |
| 3,092,575 | 6/1963 | Cox | 210/141 |
| 3,311,240 | 3/1967 | Hirsch | 210/369 |
| 3,682,310 | 8/1972 | Valdespino | 210/369 |
| 4,000,074 | 12/1976 | Evans | 210/369 |
| 4,297,210 | 10/1981 | Delfosse | 210/107 |

FOREIGN PATENT DOCUMENTS

| | | | |
|---|---|---|---|
| 886644 | 10/1943 | France | 494/58 |

OTHER PUBLICATIONS

"Quadramatic II"-Western States Machine Co., Bulletin CD-100-2.

*Primary Examiner*—Benoit Castel
*Assistant Examiner*—Linda Evans
*Attorney, Agent, or Firm*—William H. Eilberg

[57] ABSTRACT

An improved desludging device for basket centrifuges facilitates the automatic withdrawal of hard sludge from the centrifuge. The device includes a sludge discharge tube and a sludge re-slurrying tube, the tubes being connected in a loop, so that fluid exiting the centrifuge through the discharge tube reenters the centrifuge through the re-slurrying tube. The re-slurrying tube terminates in one or more nozzles or slots, pointed in the general direction of the discharge tube. This continual recirculation of fluid causes the hard sludge in the centrifuge to return to the form of a slurry, and the slurry is periodically withdrawn from the centrifuge. The re-slurrying effect may be enhanced by the occasional introduction of some process liquid, or other liquid, into the centrifuge. The sludge discharge tube and re-slurrying tube are mechanically linked, and are programmed to move towards the rim of the centrifuge until substantially all the sludge is removed. In alternative embodiments, the apparatus automatically starts and stops the re-slurrying and discharge cycle.

16 Claims, 9 Drawing Figures

Fig. 1
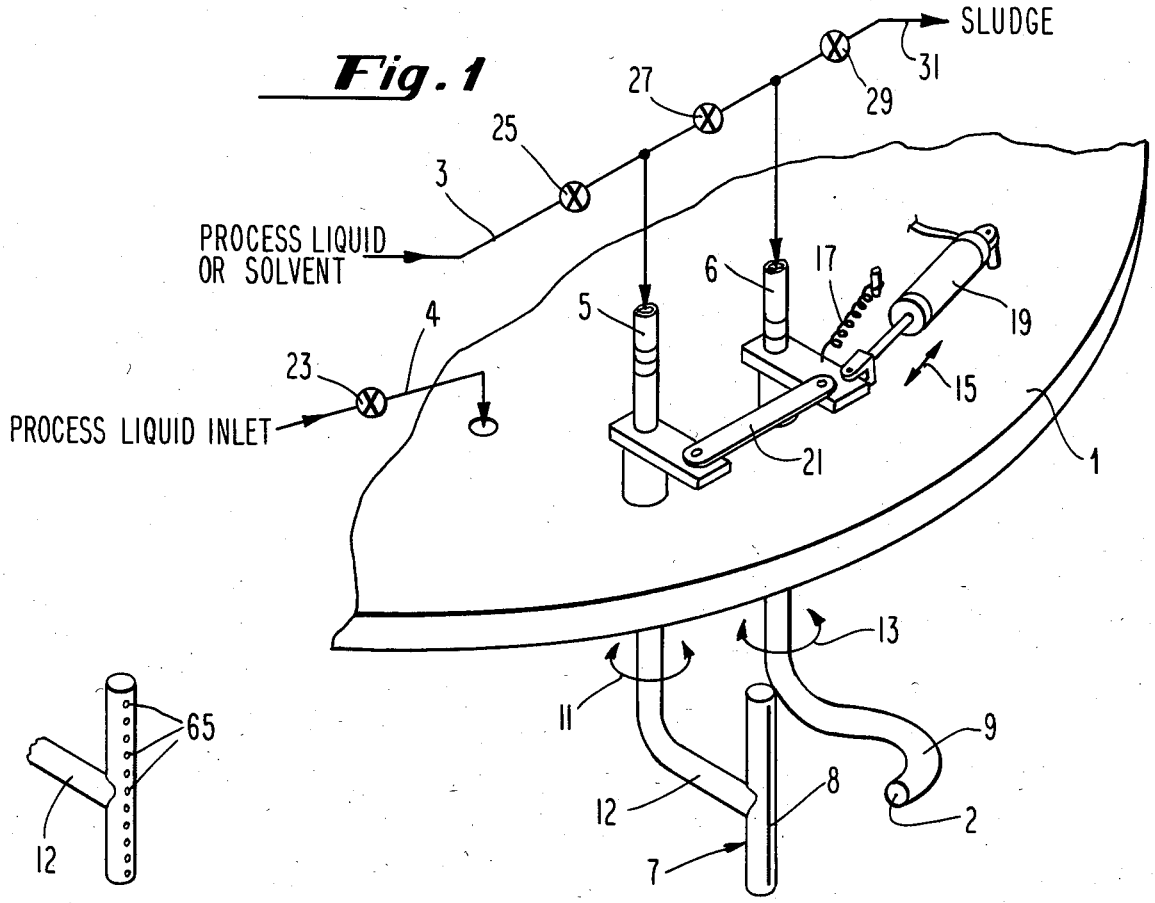
Fig. 1A
Fig. 2
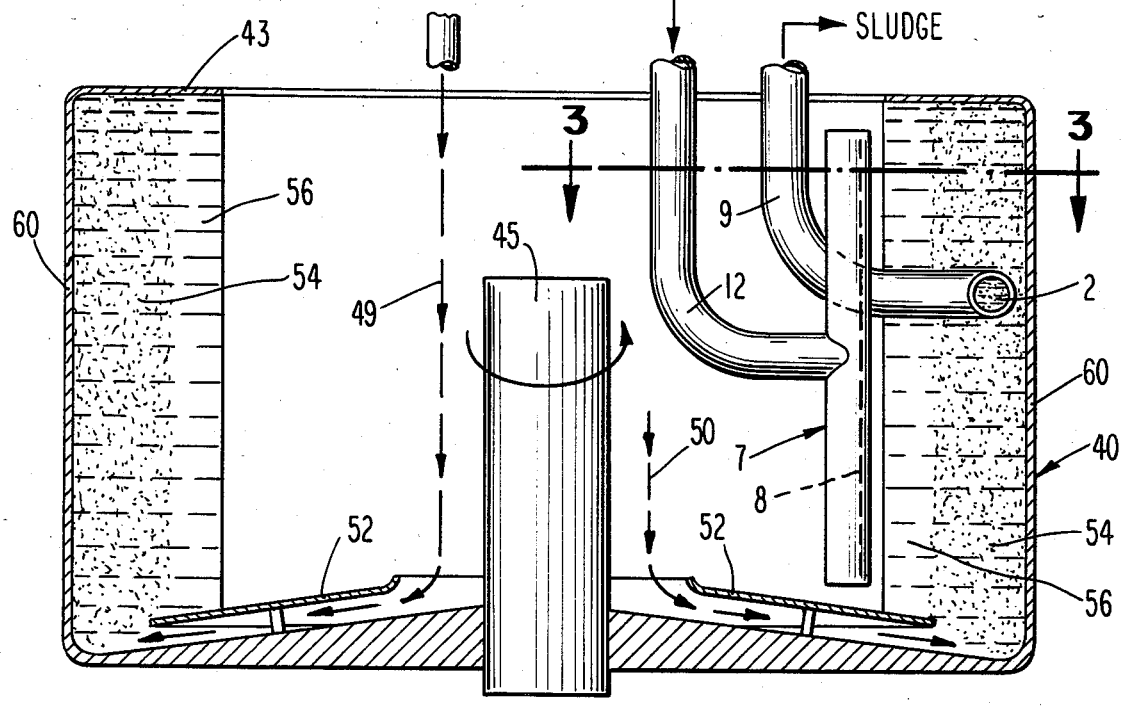

DESLUDGING DEVICE FOR CENTRIFUGES

BACKGROUND OF THE INVENTION

The present invention relates to the field of centrifuges. More particularly, the invention comprises a device for removing hard sludge automatically from the interior of a centrifuge basket.

In a basket centrifuge, a liquid containing solid material is directed into a rapidly rotating basket. As the basket spins, the solid particles in the liquid migrate to the basket wall, due to centrifugal force. As more and more liquid/solid mixture is added to the basket, the clarified liquid overflows the sides of the basket, while the solid material remains trapped along the basket wall. The clean liquid is then recovered by suitable collecting means outside the basket.

After prolonged use of the centrifuge, there is a substantial accumulation of solid material along the basket wall. This material, referred to generally as "sludge", reduces the efficiency of the centrifuge by occupying space that would otherwise be filled with liquid. The sludge must therefore be periodically removed in order to enable the centrifuge to process additional liquid at the normal rate.

Sludge is generally classified in two groups. There is the socalled "soft" or gelatinous sludge, such as that which results from the separation of impurities from several industrial processes, such as electroplating, degreasing, or paint spraying. The other kind of sludge is "hard" sludge, which results from metal fines, glass fines, sugar crystals, and the like. This invention is directed to the special problems associated with hard sludge.

Soft sludge may be conveniently removed from a centrifuge basket by introducing a discharge tube into the centrifuge while the basket is spinning. The relative motion of the basket and the tube causes the soft sludge to be extruded through the tube, and discharged into an appropriate collection container. The tube need only be moved radially, i.e. towards and away from the rim of the basket. The tube need not be moved vertically within the basket, since the soft sludge will migrate in a vertical direction towards the tube.

Hard sludge is not as easily removed from a centrifuge. Not only does hard sludge tend to clog the discharge tube, but it becomes firmly packed along the basket wall, and does not migrate vertically to the location of the tube. The simple expedient of using a single discharge tube, which is satisfactory for soft sludge, will not work satisfactorily for hard sludge.

The problem of removing solid particles from centrifuge components has been addressed in various ways in the prior art. For example, U.S. Pat. No. 3,682,310 shows a centrifuge having a filter disposed therein. A stream of air is periodically directed against the filter to loosen particles which have accumulated on the filter element. U.S. Pat. No. 4,000,074 shows a centrifuge wherein dried particles of explosive material fall out of the centrifuge by gravity. U.S. Pat. No. 2,206,401 uses a spray means directed into the centrifuge basket, apparently to inject a washing agent into the apparatus. U.S. Pat. No. 614,764 shows a centrifuge for separating sugar syrup from sugar crystals, wherein the crystals are removed from the bottom of the apparatus. U.S. Pat. No. 3,311,240 shows another sugar centrifuge, including a spray means for washing or coating the solid particles.

Nothing in the known prior art teaches a satisfactory automatic method for removal of hard sludge. The only known prior art technique for automatically scraping hard sludge from the basket wall requires actuated blades to "plow" the material loose. This technique is a slow-speed process, and requires high power. In addition to the need for specialized drive components, this prior art technique requires parts which wear rapidly, due to the abrasive character of the sludges.

The only alternative to the above-described technique has been manual cleaning. It has been necessary to stop the centrifuge, remove the basket, and replace it with a spare basket, while the original basket is cleaned by hand. This procedure is cumbersome and inefficient. Not only is it difficult to remove the sludge manually, but the method requires that the system be stopped every time a cleaning is necessary.

The present invention provides an apparatus which overcomes the above-described difficulties in removing hard sludge from a centrifuge. The invention requires only minimal contact with the abrasive sludge, in the re-slurrying process. The invention also comprises a method of removing such sludge. By use of the present invention, sludge may be removed from a centrifuge basket without manual cleaning, and without stopping the entire system. The invention may be used to remove many different kinds of hard sludge, having different degrees of hardness.

SUMMARY OF THE INVENTION

In its simplest form, the present invention comprises two tubes disposed within the centrifuge basket. One tube is a sludge reslurrying tube, and the other is a sludge discharge tube. The discharge tube and re-slurrying tube can be connected, through appropriate valves, to form a closed loop, so that fluid entering the discharge tube is recirculated into the centrifuge through the re-slurrying tube. The re-slurrying tube terminates in a nozzle, or spray slot, which is pointed in the general direction of the sludge discharge tube. The end of the discharge tube is curved, so that the opening at its end is tangential to the oncoming flow of liquid. The recirculated fluid is thereby directed, at high velocity, at the sludge deposits on the basket wall and back into the discharge tube. The spray therefore causes the sludge to become at least partially mixed into a slurry, and tends to maintain a uniform distribution of liquid and solid material.

Periodically, the recirculation path from the discharge tube to the re-slurrying tube is closed off, by a suitable valve, and the slurry entering the discharge tube is then withdrawn from the apparatus. Additional liquid, either process liquid or liquid from a separate source, is then added to the centrifuge basket, to compensate for the loss of liquid in the slurry, and to facilitate the sludge removal process.

The sludge discharge tube and sludge re-slurrying tube are mechanically linked, and rotate together. Rotation of these tubes causes the nozzle and the curved portion of the discharge tube to assume varying radial positions within the centrifuge basket. The tubes are configured so that the discharge tube always leads the reslurrying tube. That is, the curved end of the discharge tube is always closer to the wall of the basket than is the nozzle of the reslurrying tube. When the discharge tube reaches the vicinity of the wall of the basket, virtually all of the sludge has been removed, and the cleaning process is complete.

The apparatus includes a plurality of valves which direct the flow of fluids into the proper channels. Operation of these valves causes the recirculation path from the discharge tube to the reslurrying tube to be opened or closed, and also controls the flow of fluids into and out of the entire apparatus. The valves, and the motor (or hydraulic cylinder, or other device) which rotates the tubes, are actuated by timers which are pre-programmed according to the type of sludge being removed.

In another embodiment, the tubes are pre-programmed to pause at various points along their path of travel, so that the slurry in the basket may be discharged. The pre-programming may be accomplished by a plurality of cams which actuate a switch. The switch then signals a microprocessor, which initiates the sequence of valve openings and closings necessary to remove the slurry from the basket.

In another automatic embodiment, the tubes are programmed to stop for discharge of the slurry whenever the tubes encounter resistance to movement, due to the presence of a wall of hard sludge. Resistance to movement may be detected by measuring the current in a drive motor, the current tending to increase rapidly when the tubes encounter resistance. Instead of measuring motor current, the apparatus can measure the pressure drop between the re-slurrying and discharge tubes. When the viscosity of the slurry reaches a predetermined level, the pressure drop will increase beyond a corresponding level, causing the apparatus to initiate the slurry discharge cycle. In this automated embodiment, there is no need to make an accurate prior estimate of the time needed for desludging.

When desludging is completed, the sludge discharge tube and sludge re-slurrying tube may be rotated into the inoperative position, near the center of the basket, in the region which contains no liquid while the basket is spinning. Thus, the desludging apparatus does not interfere with normal centrifuging operations. The entire apparatus may therefore be programmed to cycle through centrifuging and desludging procedures, without the need for manual cleaning or for other manual control.

It is therefore an object of the present invention to provide apparatus for automatic removal of hard sludge from a centrifuge.

It is another object of the invention to provide apparatus as described above, wherein the centrifuge need not be stopped in order to remove the sludge.

It is another object of the invention to provide apparatus as described above, wherein the apparatus may be operated by preprogrammed timers, to remove sludges of a known hardness.

It is another object of the invention to provide apparatus as described above, wherein the apparatus automatically determines the required rate of desludging, according to the sensed hardness of the sludge.

It is another object of the invention to provide apparatus as described above, wherein the apparatus automatically determines the required rate of desludging, according to the sensed viscosity of the slurry within the centrifuge.

It is another object of the invention to provide apparatus as described above, wherein the sludge removal apparatus can rest within the centrifuge basket while not in use, without interfering with normal operation of the centrifuge.

It is another object of the invention to provide apparatus as described above, wherein the apparatus permits the addition of process liquid, or other liquid, into the centrifuge to facilitate the desludging operation.

It is another object of the invention to provide an apparatus for practicing a method for automatic removal of hard sludge from a centrifuge.

Other objects and advantages of the invention will be apparent to those skilled in the art, from a reading of the following brief description of the drawings, the detailed description of the invention, and the appended claims.

BRIEF DESCRIPTION OF THE DRAWINGS

FIG. 1 is a partially schematic, partial perspective view of the lid of the centrifuge, showing the sludge discharge and sludge reslurrying tubes, made according to the invention.

FIG. 1A is a detail of the nozzle of the sludge reslurrying tube, showing an alternative construction of the nozzle.

FIG. 2 is a cross-sectional view of the basket of a centrifuge, showing the sludge discharge and re-slurrying tubes inserted therein.

DETAILED DESCRIPTION OF THE INVENTION

Figure 7:
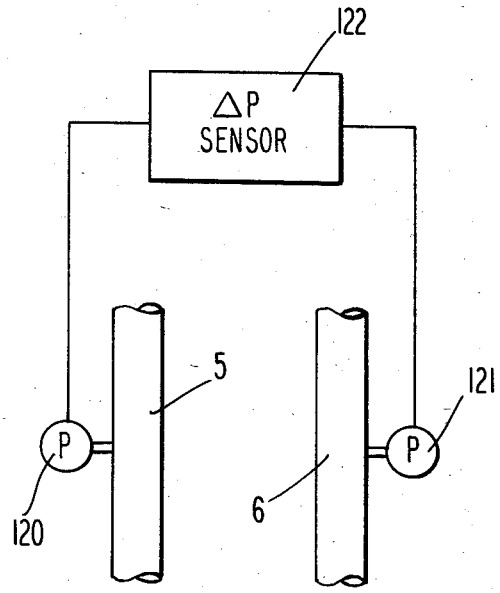
FIG. 7 is a schematic diagram of an alternative automatic embodiment, wherein the apparatus determines when the slurry needs to be discharged, based on a measurement of differential pressure.

The major features of the invention are illustrated in FIG. 1. FIG. 1 shows sludge discharge tube 9 and sludge re-slurrying tube 12, mounted within lid 1 of the centrifuge. The re-slurrying tube terminates in nozzle 7 having spray slot 8. Both the re-slurrying tube 12 and the discharge tube 9 can be rotated in either direction around their axes, as indicated by arrows 11 and 13. The discharge tube 9 has a curved end portion, the end portion being disposed in a generally horizontal position, with respect to the centrifuge basket. Thus, opening 2 of discharge tube 9 faces into the flow of liquid within the spinning basket.

Slot 8 of nozzle 7 is narrow enough to create a high-velocity flow out of the slot, but is wide enough to allow the passage of particulate matter without clogging the slot. An alternative construction for the nozzle is shown in FIG. 1A. In this embodiment, the nozzle comprises a plurality of holes 65, instead of the slot 8 of FIG. 1. It is understood that still other kinds of nozzles may be used, within the scope of this invention. What is important is that liquid be directed, at high velocity, out of the nozzle, and in the general direction of the accumulated sludge and the discharge tube.

The sludge re-slurrying tube 12 and sludge discharge tube 9 are made to rotate together by link 21. Rotation is accomplished by piston means 19, which creates motion in the direction indicated by arrow 15. The piston means 19 may be hydraulic or pneumatic. The tubes may also be rotated electrically, by a conventional motor, or even manually. The position of the tubes is biased by spring 17.

Instead of moving the tubes by a piston, the tubes can also be driven directly, by a suitable motor attached to the tube. In this case, spring 17 would be omitted.

It is seen from the drawings that when tubes 9 and 12 are rotated, the nozzle 7 and the open end 2 of discharge tube 9 move radially within the centrifuge basket. Thus, the tubes 9 and 12 can traverse substantially the entire region containing the sludge.

The re-slurrying tube 12 and the discharge tube 9 are the critical components for removal of hard sludge. The tubes 12 and 9 together comprise a loop, by virtue of valve 27, so that liquid entering the discharge tube 9 is recirculated through the re-slurrying tube 12. The liquid exits nozzle 7 at high velocity, and the liquid impinges on the boundary of hard sludge, causing that sludge to become loosened, and mixed more uniformly with the liquid. The resulting slurry is more easily withdrawn from the apparatus, through valve 29.

After some slurry has been removed from the apparatus, it is usually necessary to add more liquid to the basket to continue the desludging process. Liquid can enter the apparatus through conduit 3, passing through valve 25 and into pipe 5 which comprises the upper portion of sludge re-slurrying tube 12. The liquid entering at conduit 3 may be either the process liquid, i.e. the liquid which is to be purified in the centrifuge, or a solvent or other liquid from another source.

During the desludging operation, process liquid does not flow into the centrifuge, except for the liquid which is introduced intermittently, as described above. At all other times, i.e. while the centrifuge is being operated normally, process liquid can be brought into the centrifuge through an independent channel, separate from the desludging portion of the apparatus. Conduit 4, controlled by valve 23, represents this separate entry means, and is the preferred construction. It is possible, however, to design the system so that the process liquid enters the centrifuge through the re-slurrying tube.

It is noted that, in FIG. 1, the functions of discharging the slurry from the apparatus and recycling the slurry back to the reslurrying tube are performed by the same tube. These functions can also be performed by separate tubes. It is therefore understood that the term "discharge tube", as used herein, means a tube for discharging the slurry from the interior of the centrifuge, whether or not that tube leads the slurry out of the apparatus entirely, or conveys it back through a re-slurrying tube.

FIG. 2 is a cross-sectional view showing the sludge reslurrying tube 12 and the sludge discharge tube 9 inserted into the centrifuge basket 40. The basket 40 is shown rotating in the direction indicated by the arrow, the rotation being imparted by driving hub 45. Basket 40 has a lip 43 which defines a region within which liquid can be retained in the centrifuge. Arrows 49 and 50 represent symbolically the introduction of process liquid into the system. Arrows 49 and 50 thus represent the flow of liquid coming from conduit 4 of FIG. 1. The solid particles in the liquid adhere to the side wall 60 of basket 40, due to centrifugal force, and the clean liquid exits the basket by overflowing the lip 43. Diffuser 52 distributes the liquid/solid slurry evenly around the perimeter of the basket 40. The diffuser 52, however, is not an essential element of the invention.

In FIG. 2, the entire region defined by lip 43 is shown filled with liquid and/or sludge. The central region, i.e. the region within the basket 40 which is not directly under lip 43, is essentially free of liquid while the basket is spinning, except for the liquid being introduced into the centrifuge.

FIG. 2 shows a large accumulation of sludge 54 along the wall 60 of basket 40. The liquid within the centrifuge, and adjacent the sludge 54, is indicated by reference numeral 56. In FIG. 2, the sludge 54 occupies about three-quarters of the radial distance from the basket wall 60 to the inner edge of lip 43. The figure thus shows a centrifuge which has need of desludging.

It is noted that the discharge tube and re-slurrying tube do not move vertically. Because all of the sludge is re-slurried, the sludge will migrate, up or down, to the location of the discharge tube, in a manner similar to that encountered with soft sludge.

Figure 3:
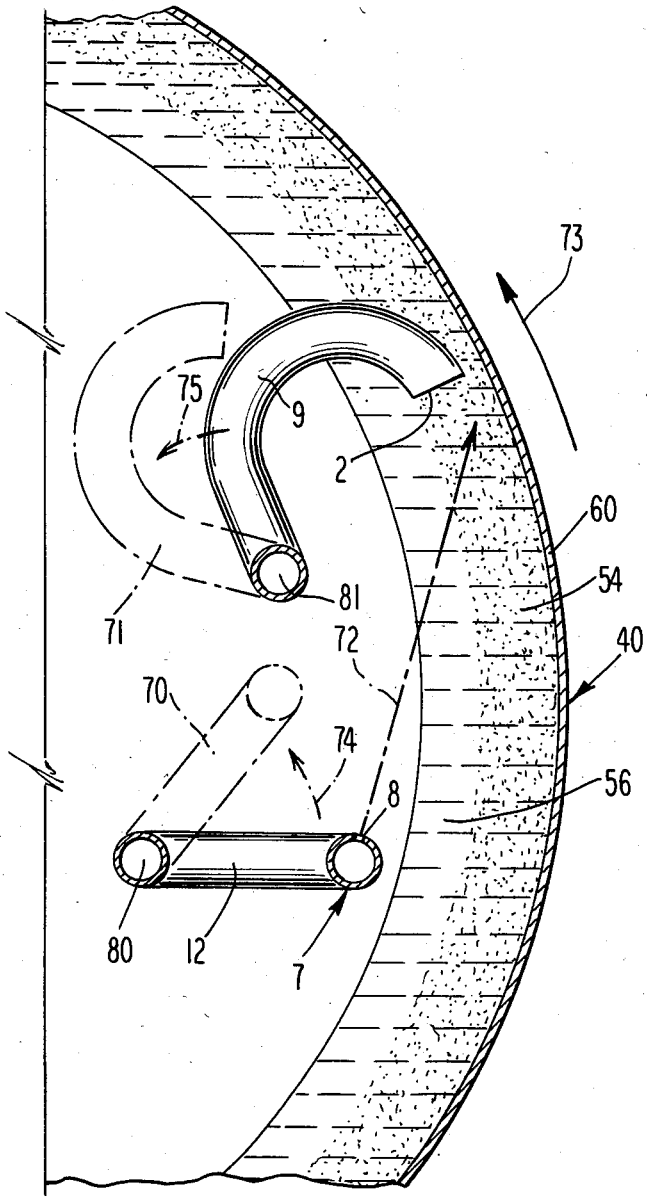
FIG. 3 is a cross-sectional view taken along the lines 3—3 of FIG. 2.

The cross-sectional view of FIG. 3 illustrates the movements of the sludge re-slurrying tube 12 and the sludge discharge tube 9. In FIG. 3, as in FIG. 2, the centrifuge basket 40 is shown spinning, in the direction shown by arrow 73. Also visible are sludge 54 and liquid 56.

The tubes 12 and 9 are rotatable around axes 80 and 81, as shown by arrows 74 and 75. Reference numerals 70 and 71 indicate, in phantom, the fully retracted positions of tubes 12 and 9, respectively. Due to their mechanical linkage, the tubes rotate together. FIG. 3 clearly shows the change in the radial position of the tubes 12 and 9 as the tubes are rotated.

Also visible in FIG. 3 is slot 8 in the nozzle 7 of reslurrying tube 12. The slot 8 is positioned so that liquid exits the nozzle in the direction indicated by arrow 72. Arrow 72 points in the general direction of the open end 2 of discharge tube 9. It is not necessary to adjust the direction of the liquid with absolute precision. In fact, the apparatus will work as long as the tube 12 points in the general direction of the sludge.

The apparatus operates in the following manner. The sludge discharge tube 9 and the sludge re-slurrying tube 12 begin in the fully retracted position, as indicated by the phantom drawings of FIG. 3. While the tubes 9 and 12 are fully retracted, the centrifuge is operated in its normal mode. That is, process liquid is added to the system through conduit 4, and clean liquid, having left the basket 40 by overflowing the lip 43, is collected by suitable external means.

When the buildup of sludge reaches a predetermined level, valve 23 is closed, shutting off the flow of additional process liquid into the basket 40. At this point, some liquid still remains inside the basket along with the sludge. Valves 25 and 29, which are already in the closed position, remain closed. Valve 27 is already open. Piston 19 is actuated to cause movement of the tubes 12 and 9 from their retracted position. Due to the mechanical linkage between the tubes 12 and 9, and due to the initial positions of the tubes, discharge tube 9 always "leads" re-slurrying tube 12. That is, the end of tube 9 is always located at a greater radial distance, from the center of basket 40, than the end of tube 12. As the tubes are rotated, they gradually move radially outward, within the basket.

The rotation of basket 40 causes liquid to flow into discharge tube 9, through the open valve 27, and back into the centrifuge through re-slurrying tube 12. This liquid then flows out of nozzle 7 as a high-velocity stream, and starts to loosen some of the sludge which has built up along the wall 60 of basket 40. After a short time, some of the sludge becomes a slurry, which can be easily discharged later from the system.

When the re-slurrying described above has proceeded for some time, the system may become ineffective in re-slurrying the remainder of the sludge, because the slurry becomes sufficiently thick to cushion the recirculated material. At this point, valve 27 is closed, and valve 29 is opened allowing the re-slurried material to be discharged from the system, at outlet 31. Then valve 29 is closed again, and valve 25 is briefly opened, allowing process liquid, or any other liquid or solvent, to enter the centrifuge. Valve 25 is then closed, and valve 27 is again opened to permit the re-slurrying process to continue. This reslurrying and slurry-discharging cycle may be repeated as needed, depending on the type and amount of sludge to be removed.

When the sludge removal process is complete, the tubes 12 and 9 return to the fully-retracted position. Valves 25 and 29 are closed, and valves 23 and 27 are then opened to resume normal centrifuging. Valve 27 could also remain closed during the centrifuging process, but it is preferable to leave it open, for reasons of safety.

In the preferred embodiment, the discharge tube 9 and re-slurrying tube 12 do not rotate radially outwardly in one unbroken motion. Instead, at the beginning of the desludging procedure, the tubes are rotated so as to move radially outward for a short, pre-set distance. Then, the tubes are stopped, and the procedure, described above, for discharging the slurry, is executed. Then, the tubes resume their rotation radially outward, and so on. Each radially outward movement results in more slurry being produced from sludge located farther towards the wall of the basket. Each pause in the radially outward movement allows the system to discharge the slurry produced so far, before more re-slurrying is attempted.

The movements of the discharge and re-slurrying tube may be controlled in one of two ways. In the first alternative, the tubes are moved by timer-actuated motors. The rate at which the tubes travel towards the wall of the basket is predetermined, according to the type of sludge in the centrifuge. The harder the sludge, the more time is required for desludging, and the travel speed of the tubes must be slower. Also, a harder sludge requires more frequent ratchetlike motions. The opening and closing of valves 25, 27, and 29 may also be controlled by conventional timers.

Figure 4A:
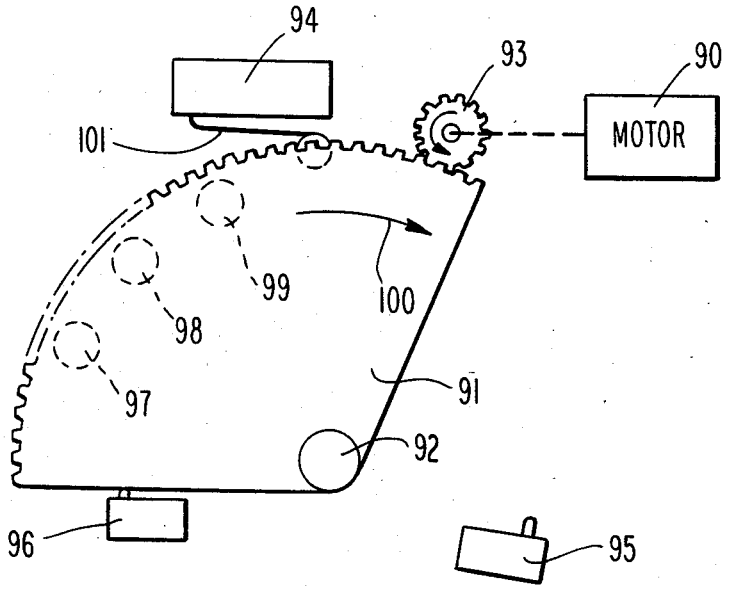
FIGS. 4A and 4B illustrate a partially schematic top view of an alternative embodiment, wherein the desludging is automated, through use of a rotating gear.
Figure 4B:
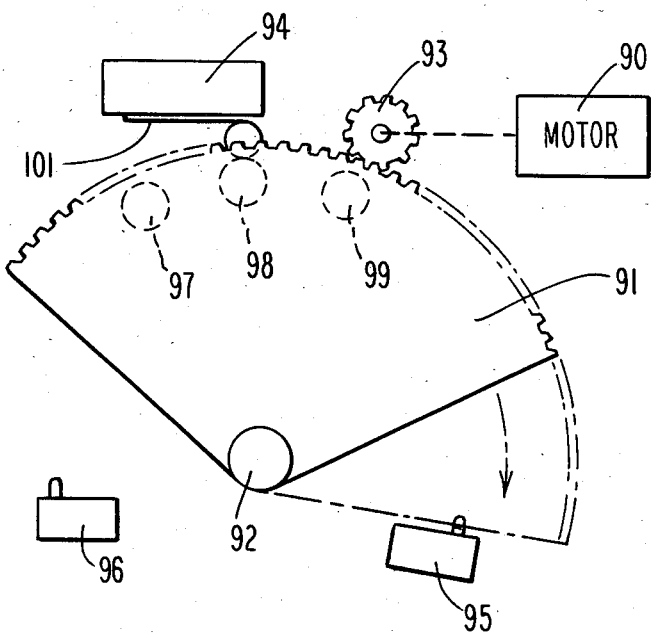

An alternative embodiment, which is more automated, is illustrated in FIGS. 4A and 4B. In this embodiment, the sludge discharge tube and sludge re-slurrying tube are rotated by a motor-driven gear arrangement. Gear 91 is mounted to rotate shaft 92, as indicated by arrow 100, the shaft being connected to the discharge tube or the reslurrying tube (not shown in FIG. 4). Gear 91 is rotated by driving gear 93, which is driven by motor 90. Disposed along the gear 91 are several cams 97, 98, and 99. Only three cams are shown, for the sake of clarity, but more cams may be used. Each cam represents a point at which the tubes will stop, so that the slurry in the centrifuge can be discharged. The cams may be spaced at equal intervals, but the spacing may be varied to suit particular types of sludges.

Disposed around gear 91 are three switches, labeled by reference numerals 94, 95, and 96. Switch 96 is disposed to sense the condition wherein the discharge and re-slurrying tubes are in the "home", or fully retracted, position. Switch 95 senses the condition wherein the tubes have reached the end of travel, i.e. the wall of the basket. Switch 94, through arm 101, senses the presence of one of the cams.

FIG. 4A illustrates gear 91 in the "home" position. FIG. 4B illustrates the gear in an intermediate position, the arm 101 of switch 94 being pushed in by cam 98. FIG. 4B also illustrates, in phantom, gear 91 when it has reached the end of travel, and is actuating switch 95.

Figure 6:
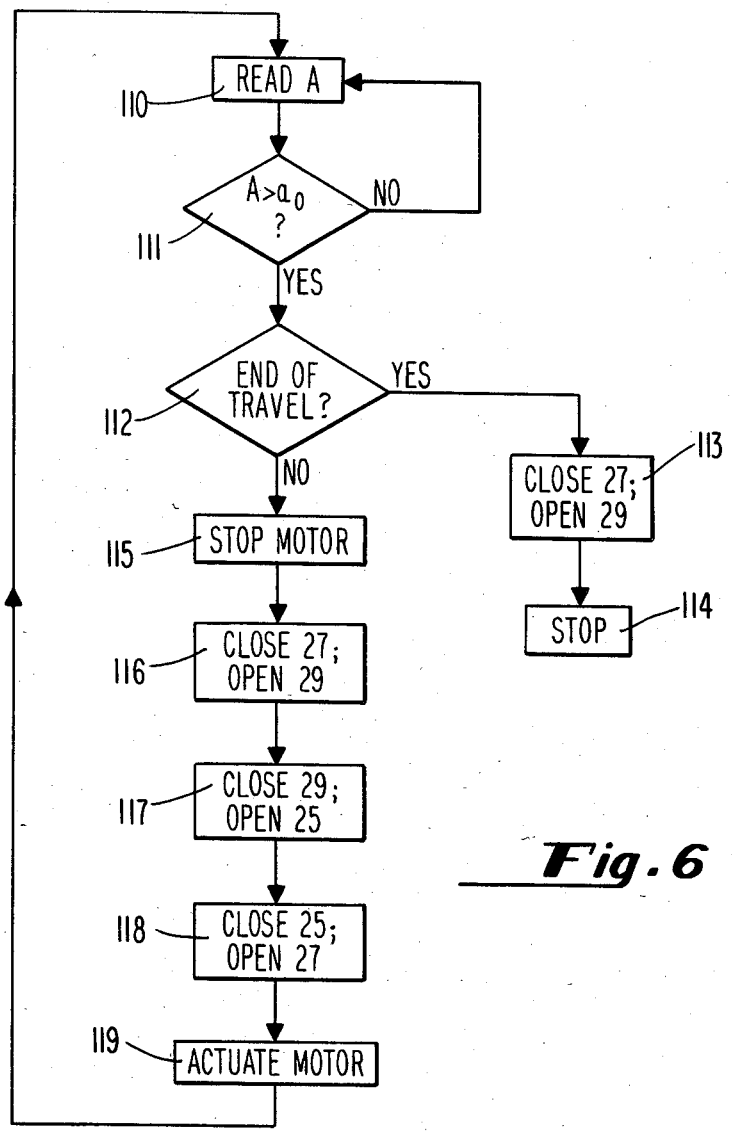
FIG. 6 is a flow diagram illustrating the steps required in automatically controlling the desludging process.
Figure 5:
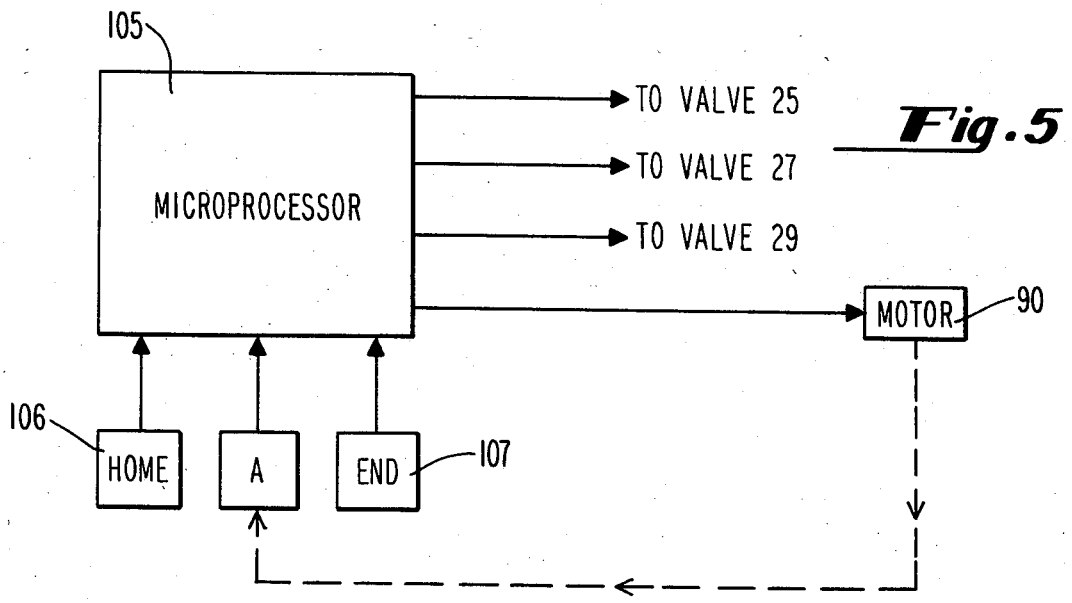
FIG. 5 is a schematic diagram illustrating the means of control of the desludging device in the various automated embodiments.

The means of control for the embodiment of FIG. 4 is illustrated in FIGS. 5 and 6. The system is controlled by microprocessor 105, which receives three inputs. One input, designated by reference numeral 106, is from switch 96, indicating that the gear 91 is in its "home position". The input designated by reference numeral 107 comes from switch 95, and indicates whether the gear 91 has reached the end of its path of travel. The third input, designated "A", signals a condition to the microprocessor which causes the tubes to be stopped during their course of travel, so that the slurry in the centrifuge can be discharged. In the embodiment of FIG. 4, input A represents the presence or absence of a signal from switch 94. In this embodiment, the connection shown from the motor to the input A would not be employed.

Microprocessor 105 has three output lines, connected so as to open and close valves 25, 27, and 29.

FIG. 6 illustrates an example of the programming of the microprocessor. The program begins in block 110, by reading input A, which is described above. In test 111, input A is compared with a reference signal, designated $a_0$. In the embodiment of FIG. 4, $a_0$ could simply be zero, input A being tested to detect whether or not switch 94 has been actuated. If the test is not satisfied (i.e. if switch 94 is not actuated), the program returns to block 110 and reads A again.

Ultimately, the condition in test 111 will be satisfied. Then, the program, in test 112, determines whether the apparatus has reached its end of travel. This test essentially comprises sensing the condition of input 107 (i.e. the output of switch 95). If the end of travel has been reached, the program proceeds to block 113, and causes microprocessor 105 to issue signals to close valve 27, and to open valve 29, thereby causing the remaining slurry to be discharged. The apparatus is then stopped in block 114.

If the end of travel has not been reached, the microprocessor, in block 115, issues a command to stop the motor. Then, in block 116, valve 27 is closed, and valve 29 is opened, allowing the slurry to be discharged. After a short, pre-programmed interval, the microprocessor continues in block 117, wherein valve 29 is closed and valve 25 is opened. Thus, additional liquid is allowed into the basket to replace the liquid lost when the slurry was discharged. After another short time delay, valve 25 is closed, as shown in block 118, and valve 27 is opened, so as to allow the re-slurrying process to continue. In block 119, the microprocessor actuates the motor, and the program returns to block 110.

As stated above, the program illustrated in FIGS. 5 and 6 uses a general input A to determine when to stop the tubes and discharge the slurry. In the embodiment described above, input A comes from the actuation of switch 94 by one of the cams on gear 91. Thus, in this embodiment, the sludge re-slurrying and discharge tubes stop at preprogrammed intervals, without regard to the actual condition of the slurry in the basket.

In another alternative automatic embodiment, the apparatus itself determines when to discharge the slurry, without being pre-set to stop at certain intervals. For example, as indicated schematically by the dotted line in FIG. 5, input A, instead of representing the output of switch 94, can represent the current flowing through motor 90. When the sludge discharge tube encounters resistance due to the wall of hard sludge, the current in the motor increases, as the motor attempts unsuccessfully to maintain the motion of the tubes. The program thus senses when the current rises above a certain level (which level would be $a_0$ in test 111 of FIG. 6). When the current exceeds that level, the apparatus "knows" that either the tube is abutting a wall of hard sludge, indicating a need for discharging the slurry and introducing more liquid, or the tube has reached the wall of the basket. Therefore, in this embodiment the apparatus stops only when it is actually necessary to stop. Clearly, the number of stops required will vary with different types of sludge.

In still another embodiment, illustrated schematically in FIG. 7, the need for discharge of the slurry is sensed by measuring a differential pressure. FIG. 7 illustrates a portion of pipes 5 and 6 of FIG. 1. The pipes are provided with pressure sensors 120 and 121, and differential pressure sensor 122 measures the pressure difference between sensors 120 and 121. The output of sensor 122 becomes the input A of FIGS. 5 and 6. When the slurry has become relatively viscous, indicating the need for discharge, the pressure drop between pipes 5 and 6 increases, as pipe 6 tends to become more and more clogged. When the pressure drop exceeds a pre-set limit (which would be $a_0$ in test 111 of FIG. 6), the apparatus automatically stops the tubes and discharges the slurry.

It is clear that FIGS. 5 and 6 can represent at least three automated embodiments of the invention. Input A can be the signal from switch 94 which is actuated by the cams on gear 91. Input A can instead be a signal indicating that the current in motor 90 has exceeded a pre-set level. Input A can also be a signal indicating that the pressure drop between the re-slurrying tube and discharge tube has exceeded a pre-set level. Other parameters can be chosen for input A, within the scope of the invention.

The embodiment of FIG. 7 has the advantage of automatically discharging slurry from the basket, when the slurry becomes viscous. In the automatic embodiment wherein the motor current is monitored, there is likely to be more wear on the discharge tube, because slurry discharge is not initiated until the discharge tube has pushed into the wall of hard sludge.

There are various other modifications possible to the above-described embodiments. Varying speeds of travel could be employed, and these speeds could be programmed into the microprocessor. Also, the sludge discharge tube and the sludge re-slurrying tube can be rotated independently, using separate motors, instead of using the linkage shown herein.

It is also understood that the microprocessor could be replaced with mechanical means for accomplishing the same object. Still another alternative is to use, instead of a microprocessor, a combination of solid state switches and timers. Such a combination would have the advantage of requiring fewer moving parts (or none at all), as compared with a purely mechanical or electromechanical arrangement, although it might not have the flexibility of an actual microprocessor. Any of these embodiments may be used, as long as the embodiment chosen implements the logic which is illustrated in FIG. 6 and described above. It is believed that, in most cases, a microprocessor is a convenient means for implementing the invention.

It is also noted that other means for detecting resistance to movement of the discharge tube can be used. Instead of measuring the current in the motor, one could directly monitor the speed of rotation of the tubes, and could sense when that speed has fallen sharply. Knowledge of the speed of rotation of the tubes, coupled with knowledge of the absolute position of the tubes, is sufficient to control the apparatus in the automatic manner contemplated by FIGS. 5 and 6.

Other modifications can be made to the invention. The size, shape, and direction of the nozzle may be changed. The particular internal structure of the centrifuge basket may be varied. The means of rotating the tubes and controlling the valves may be changed. The automated embodiment, while described with reference to a motor and gear arrangement, could be powered by hydraulic or pneumatic drive mechanisms. As noted earlier, the apparatus may be controlled electronically by a microprocessor, or by purely mechanical means. These and other modifications are to be deemed within the spirit and scope of the following claims.

What is claimed is:

1. Apparatus for removing sludge from a centrifuge, comprising:

(a) an inlet nozzle means disposed within the centrifuge, and (b) a discharge tube means disposed within the centrifuge, the discharge tube means being rotatable around its longitudinal axis, the discharge tube means and the inlet nozzle means being connected to conduits extending into the centrifuge, the discharge tube means and the inlet nozzle means being fluidly connected to each other, wherein material discharged through the discharge tube means can reenter the interior of the centrifuge through the inlet nozzle means.

2. The apparatus of claim 1, wherein the inlet nozzle means comprises a slotted cylindrical member.

3. The apparatus of claim 2, wherein the inlet nozzle means and discharge tube means are rotatable around their longitudinal axes, the conduits being mechanically linked, wherein rotation of one of the conduits causes rotation of the other conduit.

4. The apparatus of claim 3, further comprising three valve means, the first valve means controlling the flow of liquid via an entry means from an external source into the inlet nozzle means, the second valve means controlling the flow of liquid between the discharge tube means and the inlet nozzle means, and the third valve means controlling the flow of liquid from the discharge tube means via an exit means out of the apparatus.

5. The apparatus of claim 4, further comprising separate valve means associated with a conduit means for entry of process liquid into the apparatus.

6. The apparatus of claim 5, wherein the cylindrical member of the nozzle means extends along most of the height of the centrifuge basket.

7. The apparatus of claim 6, wherein the slot of the cylindrical member is pointed in the general direction of the sludge.

8. The apparatus of claim 1, wherein the inlet nozzle means comprises a cylindrical member having a plurality of holes.

9. Apparatus for removing hard sludge from a basket centrifuge, comprising:

(a) a pair of generally cylindrical pipes, mounted in the lid of the centrifuge, (b) the pipes terminating, respectively, in a nozzle means and a discharge tube, the nozzle means and discharge tube being disposed within the basket of the centrifuge, (c) the nozzle means including a slot oriented in the general direction of the sludge, said nozzle means being fluidly connectable to an external source of liquid, (d) first valve means for controlling the flow of liquid into the nozzle means from said external source, via a conduit means, (e) second valve means for controlling the flow of liquid from the discharge tube via a conduit means back into the nozzle means, and (f) third valve means for controlling the flow of liquid out of the discharge tubing a conduit means out of the apparatus.

10. The apparatus of claim 9, wherein the discharge tube has a curved end, the curved end being oriented in a generally horizontal position with respect to the centrifuge basket.

11. The apparatus of claim 10, wherein the pipes are rotatable around their longitudinal axes, and wherein rotation of the pipes causes a change in the radial position of the nozzle and the end of the discharge tube.

12. Apparatus for removing sludge from a centrifuge, comprising:

(a) a sludge re-slurrying tube and a sludge discharge tube, the re-slurrying tube terminating in a nozzle means, the nozzle means being positioned to direct fluid in the general direction of the sludge, (b) means for directing fluid from the discharge tube into the re-slurrying tube, (c) means for moving the re-slurrying tube and the discharge tube towards the wall of the centrifuge, and (d) means for automatically stopping movement of the re-slurrying tube and discharge tube, and for removing slurry from the centrifuge.

13. The apparatus of claim 12, wherein the automatic stopping and removing means comprises cam means operatively connected to at least one of the tubes, switch means positioned for actuation by the cam means, and control means for stopping movement of the tubes and discharging fluid from the centrifuge upon actuation by the switch means.

14. The apparatus of claim 13, wherein the control means includes a microprocessor.

15. The apparatus of claim 12, wherein the moving means comprises a motor, and wherein the automatic stopping and removing means comprises means for sensing the current in the motor, and control means for stopping movement of the tubes and discharging fluid from the centrifuge when the sensing means detects motor current above a predetermined level.

16. The apparatus of claim 12, wherein the automatic stopping and removing means comprises means for measuring the differential pressure between the re-slurrying tube and the discharge tube, and control means for stopping movement of the tubes and discharging fluid from the centrifuge when the measuring means detects a pressure drop above a predetermined level.

* * * * *